US012072112B2

(12) United States Patent
Scott

(10) Patent No.: US 12,072,112 B2
(45) **Date of Patent: *Aug. 27, 2024**

(54) SYSTEMS AND METHODS FOR OPTIMIZING DATA ROUTING IN HVAC NETWORKS

(71) Applicant: Johnson Controls Tyco IP Holdings LLP, Milwaukee, WI (US)

(72) Inventor: Adam Scott, Grafton, WI (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/088,163

(22) Filed: Dec. 23, 2022

(65) Prior Publication Data

US 2023/0204243 A1 Jun. 29, 2023

Related U.S. Application Data

(63) Continuation of application No. 16/796,731, filed on Feb. 20, 2020, now Pat. No. 11,536,478.

(51) Int. Cl.

| | |
|---|---|
| ***F24F 11/56*** | (2018.01) |
| ***F24F 11/30*** | (2018.01) |
| ***F24F 11/52*** | (2018.01) |
| ***F24F 11/62*** | (2018.01) |

(52) U.S. Cl.

CPC ..... *F24F 11/56* (2018.01); *F24F 11/30* (2018.01); *F24F 11/52* (2018.01); *F24F 11/62* (2018.01)

(58) Field of Classification Search

CPC .. F24F 11/56; F24F 11/30; F24F 11/52; F24F 11/62; F24F 11/50

See application file for complete search history.

(56) References Cited

U.S. PATENT DOCUMENTS

| | | | | |
|---|---|---|---|---|
| 11,536,478 | B2 * | 12/2022 | Scott | F24F 11/52 |
| 2006/0067209 | A1 | 3/2006 | Sheehan et al. | |
| 2013/0218349 | A1 * | 8/2013 | Coogan | G05B 13/02 700/275 |
| 2014/0277753 | A1 * | 9/2014 | Eiynk | G05B 15/02 700/275 |
| 2015/0039752 | A1 * | 2/2015 | Hague | H04L 12/403 709/224 |
| 2016/0131388 | A1 * | 5/2016 | Eiynk | G05B 15/02 707/728 |
| 2017/0357607 | A1 | 12/2017 | Cayemberg et al. | |

* cited by examiner

*Primary Examiner* — Charles R Kasenge
(74) *Attorney, Agent, or Firm* — Foley & Lardner LLP

(57) ABSTRACT

A building management system (BMS) for optimizing network traffic. The system includes a user device that includes a user interface that is configured to display a control application for the BMS. The system further includes a routing device comprising a processing circuit, the processing circuit configured to receive an application request from the control application, gather a plurality of responses from one or more data objects, wherein the plurality of responses include a set of data object properties to satisfy the application request, perform a conversion process that converts the plurality of responses into a converted number of responses requested in the application request, wherein the converted number of responses contains the set of data object properties, and provide the converted number of responses to the control application to satisfy the application request.

20 Claims, 10 Drawing Sheets

SYSTEMS AND METHODS FOR OPTIMIZING DATA ROUTING IN HVAC NETWORKS

CROSS-REFERENCE TO RELATED PATENT APPLICATION

This application is a continuation of U.S. patent application Ser. No. 16/796,731 filed Feb. 20, 2020, the entire disclosure of which is incorporated by reference herein.

BACKGROUND

The present disclosure relates generally to building management systems. The present disclosure relates more particularly to network traffic within a building management system.

A building management system (BMS) is, in general, a system of devices configured to control, monitor, and manage equipment in or around a building or building area. A BMS can include a heating, ventilation, or air conditioning (HVAC) system, a security system, a lighting system, a fire alerting system, another system that is capable of managing building functions or devices, or any combination thereof. BMS devices may be installed in any environment (e.g., an indoor area or an outdoor area) and the environment may include any number of buildings, spaces, zones, rooms, or areas. A BMS may include VERASYS® building controllers or other devices sold by Johnson Controls, Inc., as well as building devices, controllers, and components from other sources.

SUMMARY

One implementation of the present disclosure is a building management system (BMS) that handles network traffic. The system includes a user device that includes a user interface that is configured to display a control application for the BMS. The system further includes a routing device comprising a processing circuit. The processing circuit is configured to receive an application request from the control application, gather responses from one or more data objects, and perform a conversion process that converts the responses into a converted number of responses requested in the application request. The converted number of responses contains the set of data object properties, and provide the converted number of responses to the control application to satisfy the application request, and the responses include a set of data object properties to satisfy the application request.

In some embodiments, the system further includes one or more controllers configured to store the one or more data objects. In some embodiments, the user device, the routing device, and the one or more controllers are configured to communicate via building automation control networks (BACnet) protocols, the BACnet protocols including BACnet/Ethernet, BACnet/IP, and BACnet/MSTP.

In some embodiments, gathering responses from one or more data objects includes instructing a controller in the BMS to provide one or more of the data objects stored thereon and receiving at least one of an object name, object ID, or operational parameter of the data object, wherein the data object is a device object.

In some embodiments, receiving an application request further comprises receiving a read property multiple request configured to read the set of data object properties in a single response.

In some embodiments, receiving an application request further includes receiving a write property multiple request configured to write the set of data object properties in a single write request or receiving a subscribe COV property request configured to notify the control application when the set of data object properties changes substantially.

In some embodiments, receiving an application request from the control application further includes automatically determining that the converted number of responses will be received to satisfy the application request, wherein the converted number of responses is a single response, providing, to the control application, an indication that a single response will be received to satisfy the application request, and receiving, at the control application, the single response from the routing device.

In some embodiments, performing a conversion process that converts the plurality of responses into a single response further includes receiving one of the plurality of responses from one or more data objects, wherein the one of the responses includes at least part of the set of data object properties to satisfy the application request, storing the one of the plurality of responses until all of the responses from the data objects are received, converting the number of received responses from the data objects to the number of requested responses from the control application.

Another implementation of the present disclosure is a method of providing network traffic in a building heating, ventilation, or air conditioning (HVAC) system. The method includes receiving, at a routing device, an application request from a control application from a first building automation network, gathering a plurality of responses from one or more data objects from a second building automation network, and performing a conversion process that converts the plurality of responses into a converted number of responses requested in the application request. The control application is displayed on a user device, and the responses include a set of data object properties to satisfy the application request. The converted number of responses contains the set of data object properties, and providing the converted number of responses to the control application to satisfy the application request.

In some embodiments, receiving an application request from a control application from a first building automation network further includes receiving at least one of a read property multiple request, write property multiple request, or subscribe COV property request from a building automation control networks (BACnet) protocol, and wherein the BACnet protocol is at least one of a BACnet over Ethernet (BACnet/Ethernet), BACnet over industrial protocol (BACnet/IP), or BACnet over master slave token passing (BACnet/MSTP).

In some embodiments, the one or more data objects are stored on one or more controllers. In some embodiments, the user device, the routing device, and the one or more controllers are configured to communicate via building automation control networks (BACnet) protocols, the BACnet protocols including BACnet/Ethernet, BACnet/IP, and BACnet/MSTP.

In some embodiments, gathering a plurality of responses from one or more data objects includes instructing a controller in the BMS to provide one or more of the data objects stored thereon and receiving at least one of an object name, object ID, or operational parameter of the data object, wherein the data object is a device object.

In some embodiments, receiving an application request further comprises receiving a read property multiple request configured to read the set of data object properties in a single response.

In some embodiments, receiving an application request further comprises receiving a write property multiple request configured to write the set of data object properties in a single write request and receiving a subscribe COV property request configured to notify the control application when the set of data object properties changes substantially.

In some embodiments, receiving an application request from the control application further includes automatically determining that the converted number of responses will be received to satisfy the application request, wherein the converted number of responses is a single response, providing, to the control application, an indication that a single response will be received to satisfy the application request, and receiving, at the control application, the single response from the routing device.

In some embodiments, performing a conversion process that converts the plurality of responses into a single response further includes receiving one of the plurality of responses from one or more data objects, wherein the one of the plurality of responses include at least part of the set of data object properties to satisfy the application request, storing the one of the plurality of responses until all of the plurality of responses from the data objects are received, and converting the number of received responses from the data objects to the number of requested responses from the control application.

Another implementation of the present disclosure is a routing device for routing network traffic in a building management system (BMS). The routing device includes a communications interface configured to communicate with a user device, wherein the user device is configured to display a control application for the BMS. The routing device further includes a processing circuit configured to receive an application request from the control application, gather responses from one or more data objects, perform a conversion process that converts the plurality of responses into a converted number of responses requested in the application request, and provide the converted number of responses to the control application to satisfy the application request. The responses include a set of data object properties to satisfy the application request, and the converted number of responses contains the set of data object properties In some embodiments, the system further comprises one or more controllers configured to store the one or more data objects and the user device, the routing device, and the one or more controllers are configured to communicate via building automation control networks (BACnet) protocols, the BACnet protocols including BACnet/Ethernet, BACnet/IP, and BACnet/MSTP.

In some embodiments, gathering a plurality of responses from one or more data objects includes instructing a controller in the BMS to provide one or more of the data objects stored thereon and receiving at least one of an object name, object ID, or operational parameter of the data object, wherein the data object is a device object.

In some embodiments, receiving an application request further includes receiving a read property multiple request configured to read the set of data object properties in a single response.

In some embodiments, receiving an application request further includes receiving a write property multiple request configured to write the set of data object properties in a single write request or receiving a subscribe COV property request configured to notify the control application when the set of data object properties changes substantially.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Figure 1:
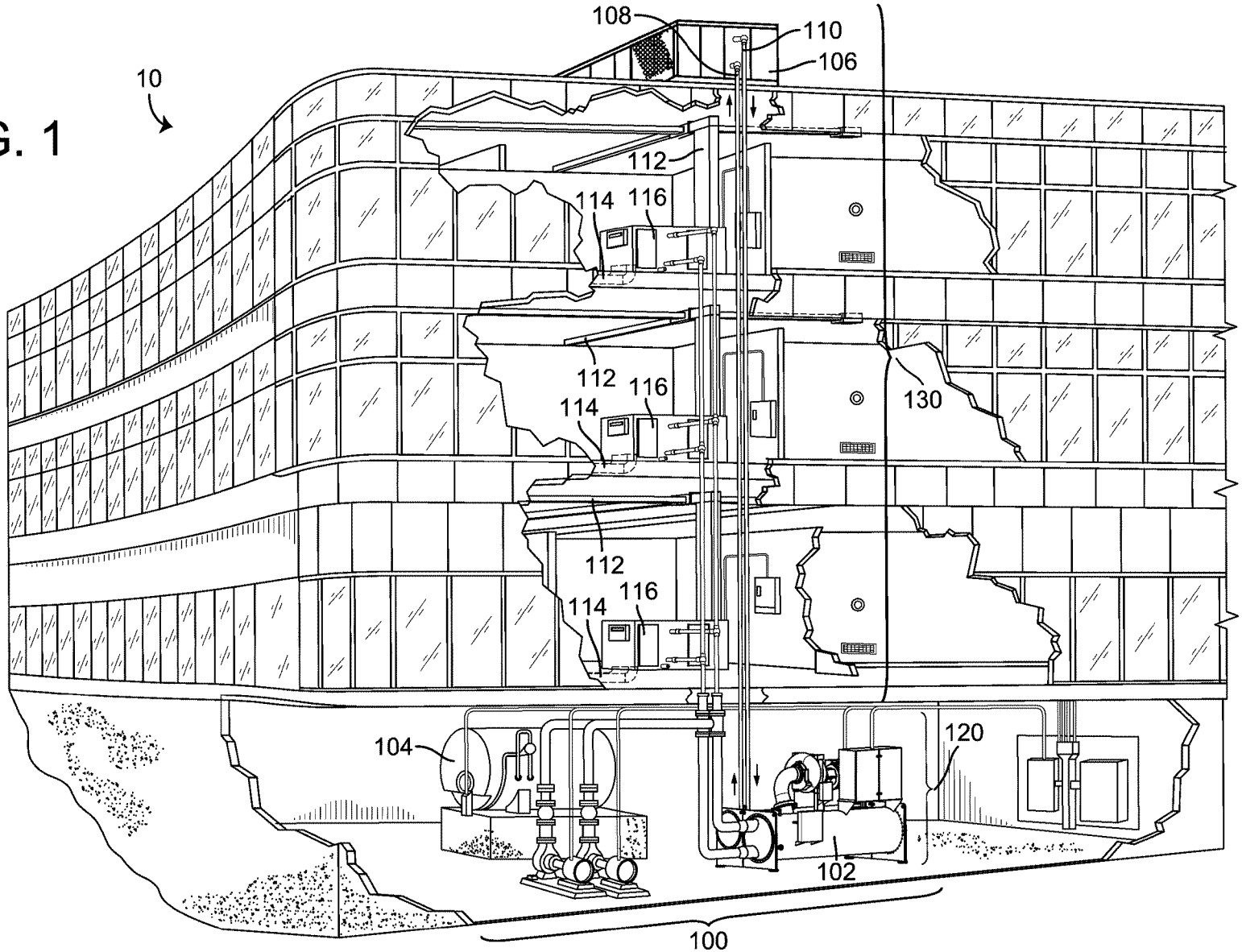
FIG. 1 is drawing of a building equipped with a heating, ventilating, and air conditioning (HVAC) system, according to some embodiments.

Referring generally to the FIGURES, a building management system (BMS) with automatic equipment discovery and equipment model distribution is shown, according to some embodiments. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof. In some embodiments, the communications on the network of the BMS are optimized or made better using systems and methods described herein.

In brief overview, the BMS described herein provides a system architecture that facilitates automatic equipment discovery and equipment model distribution. Equipment discovery can occur on multiple levels of the BMS across multiple different communications busses (e.g., a system bus, zone buses, a sensor/actuator bus, etc.) and across multiple different communications protocols. In some embodiments, equipment discovery is accomplished using active node tables, which provide status information for devices connected to each communications bus. For example, each communications bus can be monitored for new devices by monitoring the corresponding active node table for new nodes. When a new device is detected, the BMS can begin interacting with the new device (e.g., sending control signals, using data from the device) without user interaction.

Some devices in the BMS present themselves to the network using equipment models. An equipment model defines equipment object attributes, view definitions, schedules, trends, and the associated BACnet value objects (e.g., analog value, binary value, multistate value, etc.) that are used for integration with other systems. Some devices in the BMS store their own equipment models. Other devices in the BMS have equipment models stored externally (e.g., within other devices). For example, a zone coordinator can store the equipment model for a bypass damper. In some embodiments, the zone coordinator automatically creates the equipment model for the bypass damper and/or other devices on the zone bus. Other zone coordinators can also create equipment models for devices connected to their zone busses. The equipment model for a device can be created automatically based on the types of data points exposed by the device on the zone bus, device type, and/or other device attributes.

Referring generally to the FIGURES, systems and methods for optimizing network traffic is shown, according to exemplary embodiments. In some embodiments, an improved routing device (e.g., routing device 502) is configured to receive a single application request to read multiple properties of HVAC devices (i.e., device properties via data objects stored within the system). The routing device may be configured to receive several properties from one or more objects within the system (e.g., system 400, system 500, etc.) and convert the number of received responses from the data objects to the number of responses requested from the application. In the above example, this would be one response, as the routing device received a single application request.

In other exemplary embodiments, the routing device may receive a single request to write multiple properties of a data object instead of having to send multiple write property requests. For example, the routing device may receive a single application request to write 4 properties to a data object within the system (e.g., system 400, system 500, etc.). The routing device may convert the single application request to, in this case, 4 requests and write the application requests to the data object. In some embodiments, the routing device will update the application after the process is complete, or if the process was not complete (e.g., an error occurred).

In other exemplary embodiments, the routing device may receive a request from an application to be notified of changes of value (COV's) of a property of a data object instead have having to periodically poll the value. For example, the routing device may receive a single application request to be notified every time the temperature of an HVAC device rises above a predetermined threshold. In the event that this occurs, the routing device will automatically request the temperature properties from the data object and provide a response to the application.

In a general embodiment, the various systems disclosed herein operate on a building automation control networks (BACnet) protocol, including BACnet/IP, BACnet/Ethernet, and/or BACnet/MSTP. The various systems and methods disclosed herein optimize the application by providing advanced services (e.g., read property multiple, write property multiple, subscribe COV property, etc.) automatically, such that the application does not have to perform and post processing after receiving a response.

In some embodiments, it is not required to support these services on a BACnet device. Therefore, applications are not forced to support any combination of these services. For example, if a device doesn't support Read Property Multiple, the application must know to send multiple Read Property requests instead. Advantageously, instead of the application having to know what services are supported by any given BACnet device, the application can assume that the device supports these more advanced BACnet services because the BACnet router will handle any conversion between the request and response as needed.

This may then enable applications to assume that if they send out a single request to read some number of properties, it will get a single response that contains either the value of those properties or an error. This "one-to-one" correlation between request and response is beneficial as it simplifies post-processing of that data since the application knows it received all the data in that request instead of having to track all of the asynchronous requests and responses, cache the data, and then finally process it all once it has received all of the responses.

Building Management System

Referring now to FIG. 1, an exemplary building and HVAC system in which the systems and methods of the present invention can be implemented are shown, according to an exemplary embodiment. In FIG. 1, a perspective view of a building 10 is shown. Building 10 is served by a HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Figure 2:
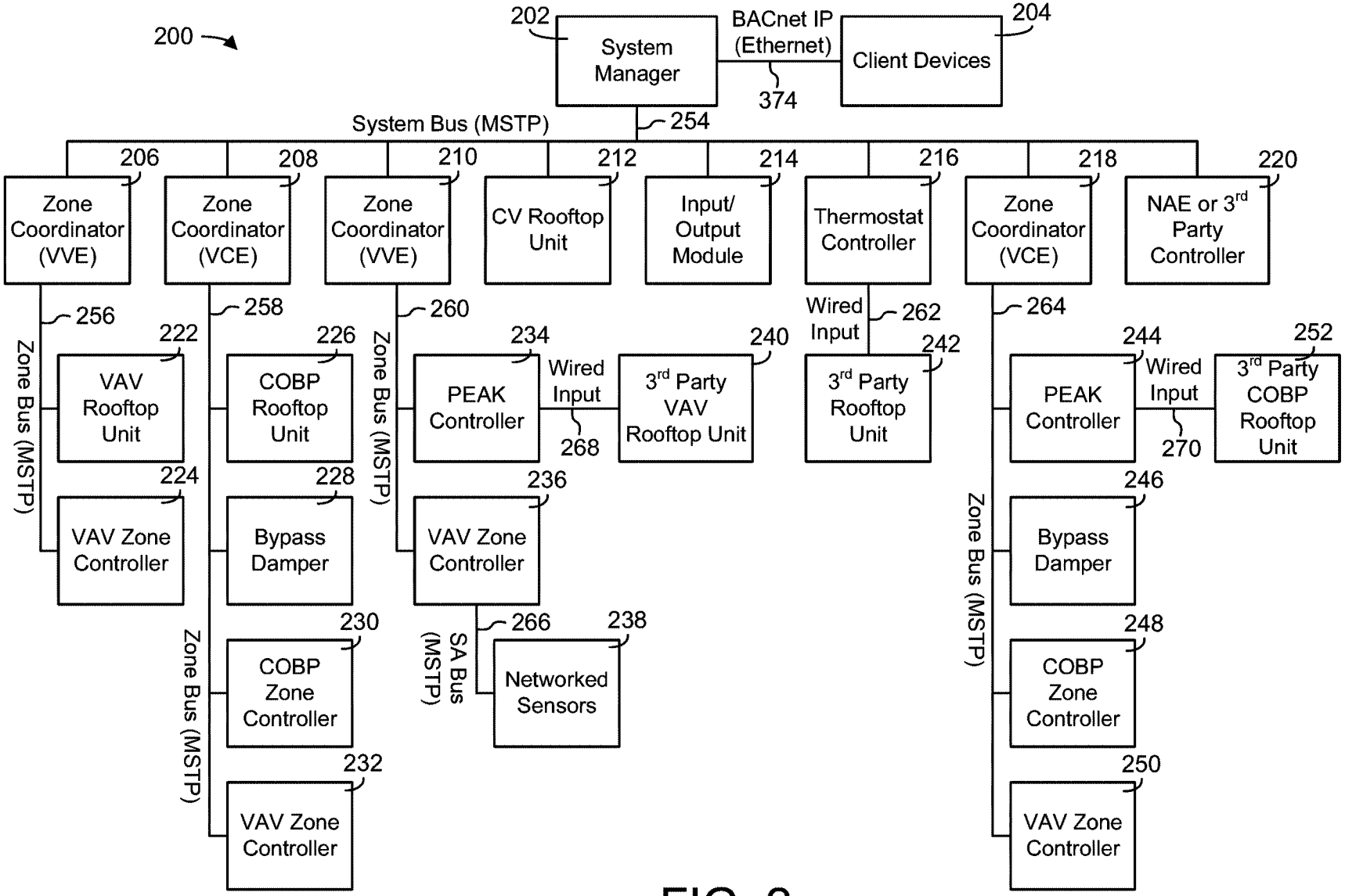
FIG. 2 is a block diagram of a building management system (BMS) which can be used to monitor and control the building and HVAC system of FIG. 1, according to some embodiments.

Referring now to FIG. 2, a block diagram of a building management system (BMS) 200 is shown, according to an exemplary embodiment. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof. BMS 200 can be used to monitor and control the devices of HVAC system 100 and/or airside system 200 (e.g., HVAC equipment) as well as other types of BMS devices (e.g., lighting equipment, security equipment, etc.).

In brief overview, BMS 200 provides a system architecture that facilitates automatic equipment discovery and equipment model distribution. Equipment discovery can occur on multiple levels of BMS 200 across multiple different communications busses (e.g., a system bus 254, zone buses 256-260 and 264, sensor/actuator bus 266, etc.) and across multiple different communications protocols. In some embodiments, equipment discovery is accomplished using active node tables, which provide status information for devices connected to each communications bus. For example, each communications bus can be monitored for new devices by monitoring the corresponding active node table for new nodes. When a new device is detected, BMS 200 can begin interacting with the new device (e.g., sending control signals, using data from the device) without user interaction.

Some devices in BMS 200 present themselves to the network using equipment models. An equipment model defines equipment object attributes, view definitions, schedules, trends, and the associated BACnet value objects (e.g., analog value, binary value, multistate value, etc.) that are used for integration with other systems. An equipment model for a device can include a collection of point objects that provide information about the device (e.g., device name, network address, model number, device type, etc.) and store present values of variables or parameters used by the device. For example, the equipment model can include point objects (e.g., standard BACnet point objects) that store the values of input variables accepted by the device (e.g., setpoint, control parameters, etc.), output variables provided by the device (e.g., temperature measurement, feedback signal, etc.), configuration parameters used by the device (e.g., operating mode, actuator stroke length, damper position, tuning parameters, etc.). The point objects in the equipment model can be mapped to variables or parameters stored within the device to expose those variables or parameters to external systems or devices.

Some devices in BMS 200 store their own equipment models. Other devices in BMS 200 have equipment models stored externally (e.g., within other devices). For example, a zone coordinator 208 can store the equipment model for a bypass damper 228. In some embodiments, zone coordinator 208 automatically creates the equipment model for bypass damper 228 or other devices on zone bus 258. Other zone coordinators can also create equipment models for devices connected to their zone busses. The equipment model for a device can be created automatically based on the types of data points exposed by the device on the zone bus, device type, and/or other device attributes. Several examples of automatic equipment discovery and equipment model distribution are discussed in greater detail below.

Still referring to FIG. 2, BMS 200 is shown to include a system manager 202; several zone coordinators 206, 208, 210 and 218; and several zone controllers 224, 230, 232, 236, 248, and 250. System manager 202 can communicate with client devices 204 (e.g., user devices, desktop computers, laptop computers, mobile devices, etc.) via a data communications link 374 (e.g., BACnet/IP, Ethernet, wired or wireless communications, etc.). System manager 202 can provide a user interface to client devices 204 via data communications link 374. The user interface may allow users to monitor and/or control BMS 200 via client devices 204.

In some embodiments, system manager 202 is connected with zone coordinators 206-210 and 218 via a system bus 254. System bus 254 can include any of a variety of communications hardware (e.g., wire, optical fiber, terminals, etc.) configured to facilitate communications between system manager and other devices connected to system bus 254. Throughout this disclosure, the devices connected to system bus 254 are referred to as system bus devices. System manager 202 can be configured to communicate with zone coordinators 206-210 and 218 via system bus 254 using a master-slave token passing (MSTP) protocol or any other communications protocol. System bus 254 can also connect system manager 202 with other devices such as a constant volume (CV) rooftop unit (RTU) 212, an input/output module (IOM) 214, a thermostat controller 216 (e.g., a TEC2000 series thermostat controller), and a network automation engine (NAE) or third-party controller 220. RTU 212 can be configured to communicate directly with system manager 202 and can be connected directly to system bus 254. Other RTUs can communicate with system manager 202 via an intermediate device. For example, a wired input 262 can connect a third-party RTU 242 to thermostat controller 216, which connects to system bus 254.

System manager 202 can provide a user interface for any device containing an equipment model. Devices such as zone coordinators 206-210 and 218 and thermostat controller 216 can provide their equipment models to system manager 202 via system bus 254. In some embodiments, system manager 202 automatically creates equipment models for connected devices that do not contain an equipment model (e.g., IOM 214, third party controller 220, etc.). For example, system manager 202 can create an equipment model for any device that responds to a device tree request. The equipment models created by system manager 202 can be stored within system manager 202. System manager 202 can then provide a user interface for devices that do not contain their own equipment models using the equipment models created by system manager 202. In some embodiments, system manager 202 stores a view definition for each type of equipment connected via system bus 254 and uses the stored view definition to generate a user interface for the equipment.

Each zone coordinator 206-210 and 218 can be connected with one or more of zone controllers 224, 230-232, 236, and 248-250 via zone buses 256, 258, 260, and 264. Zone busses 256, 258, 260, and 264 can include any of a variety of communications hardware (e.g., wire, optical fiber, terminals, etc.) configured to facilitate communications between a zone coordinator and other devices connected to the corresponding zone bus. Throughout this disclosure, the devices connected to zone busses 256, 258, 260, and 264 are referred to as zone bus devices. Zone coordinators 206-210 and 218 can communicate with zone controllers 224, 230-232, 236, and 248-250 via zone busses 256-260 and 264 using a MSTP protocol or any other communications protocol. Zone busses 256-260 and 264 can also connect zone coordinators 206-210 and 218 with other types of devices such as variable air volume (VAV) RTUs 222 and 240, changeover bypass (COBP) RTUs 226 and 252, bypass dampers 228 and 246, and PEAK controllers 234 and 244.

Zone coordinators 206-210 and 218 can be configured to monitor and command various zoning systems. In some embodiments, each zone coordinator 206-210 and 218 monitors and commands a separate zoning system and is connected to the zoning system via a separate zone bus. For example, zone coordinator 206 can be connected to VAV RTU 222 and zone controller 224 via zone bus 256. Zone coordinator 208 can be connected to COBP RTU 226, bypass damper 228, COBP zone controller 230, and VAV zone controller 232 via zone bus 258. Zone coordinator 210 can be connected to PEAK controller 234 and VAV zone controller 236 via zone bus 260. Zone coordinator 218 can be connected to PEAK controller 244, bypass damper 246, COBP zone controller 248, and VAV zone controller 250 via zone bus 264.

A single model of zone coordinator 206-210 and 218 can be configured to handle multiple different types of zoning systems (e.g., a VAV zoning system, a COBP zoning system, etc.). Each zoning system can include a RTU, one or more zone controllers, and/or a bypass damper. For example, zone coordinators 206 and 210 are shown as Verasys VAV engines (VVEs) connected to VAV RTUs 222 and 240, respectively. Zone coordinator 206 is connected directly to VAV RTU 222 via zone bus 256, whereas zone coordinator 210 is connected to a third-party VAV RTU 240 via a wired input 268 provided to PEAK controller 234. Zone coordinators 208 and 218 are shown as Verasys COBP engines (VCEs) connected to COBP RTUs 226 and 252, respectively. Zone coordinator 208 is connected directly to COBP RTU 226 via zone bus 258, whereas zone coordinator 218 is connected to a third-party COBP RTU 252 via a wired input 270 provided to PEAK controller 244.

Zone controllers 224, 230-232, 236, and 248-250 can communicate with individual BMS devices (e.g., sensors, actuators, etc.) via sensor/actuator (SA) busses. For example, VAV zone controller 236 is shown connected to networked sensors 238 via SA bus 266. Networked sensors 238 can include, for example, temperature sensors, humidity sensors, pressure sensors, lighting sensors, security sensors, or any other type of device configured to measure and/or provide an input to zone controller 236. Zone controller 236 can communicate with networked sensors 238 using a MSTP protocol or any other communications protocol. Although only one SA bus 266 is shown in FIG. 2, it should be understood that each zone controller 224, 230-232, 236, and 248-250 can be connected to a different SA bus. Each SA bus can connect a zone controller with various sensors (e.g., temperature sensors, humidity sensors, pressure sensors, light sensors, occupancy sensors, etc.), actuators (e.g., damper actuators, valve actuators, etc.) and/or other types of controllable equipment (e.g., chillers, heaters, fans, pumps, etc.).

Each zone controller 224, 230-232, 236, and 248-250 can be configured to monitor and control a different building zone. Zone controllers 224, 230-232, 236, and 248-250 can use the inputs and outputs provided via their SA busses to monitor and control various building zones. For example, a zone controller 236 can use a temperature input received from networked sensors 238 via SA bus 266 (e.g., a measured temperature of a building zone) as feedback in a temperature control algorithm. Zone controllers 224, 230-232, 236, and 248-250 can use various types of control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control a variable state or condition (e.g., temperature, humidity, airflow, lighting, etc.) in or around building 10.

Figure 3:
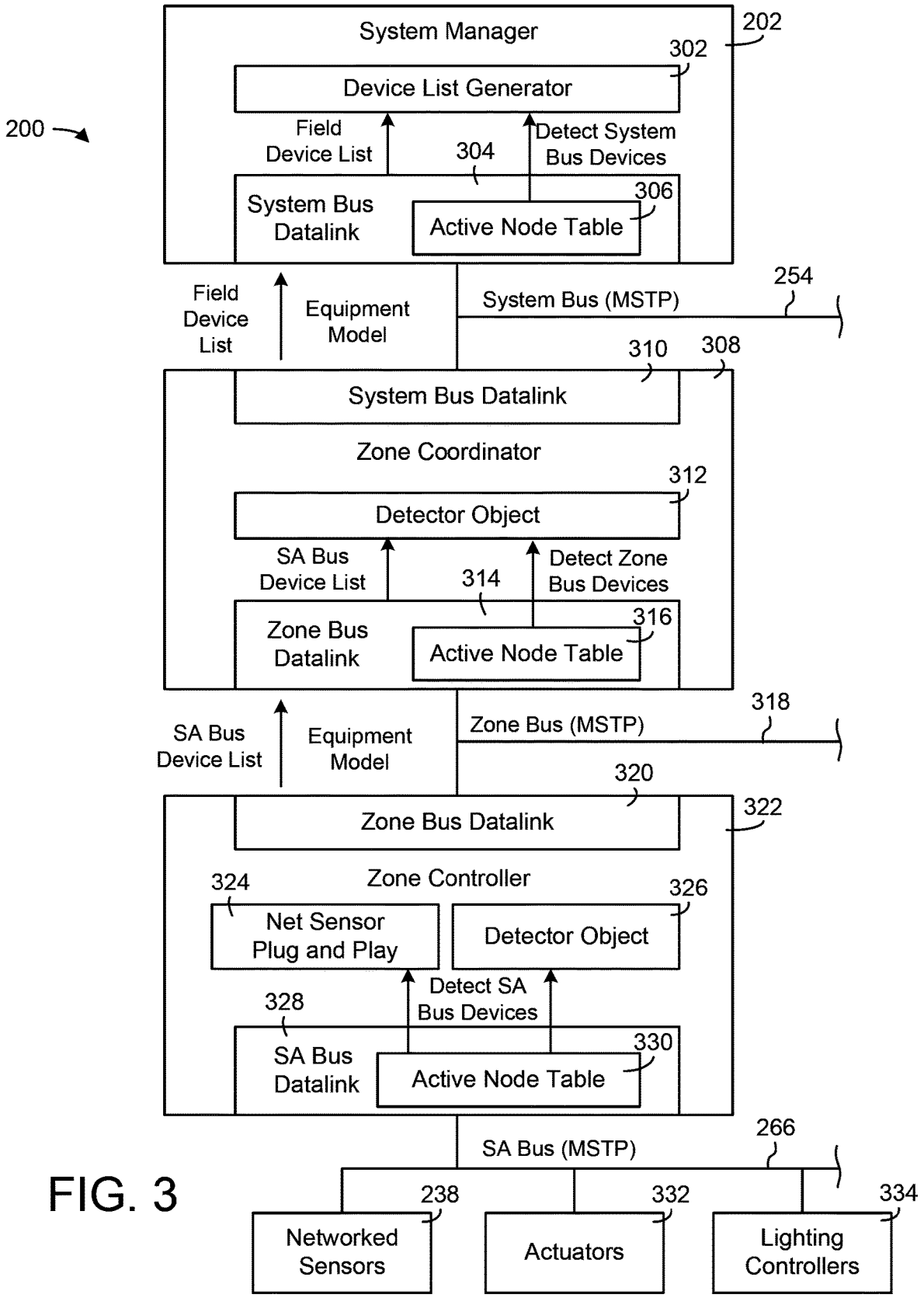
FIG. 3 is a block diagram illustrating a system manager, zone coordinator, and zone controller of the BMS of FIG. 2 in greater detail, according to some embodiments.

Referring now to FIG. 3, a block diagram illustrating a portion of BMS 200 in greater detail is shown, according to an exemplary embodiment. BMS 200 is shown to include system manager 202, a zone coordinator 308, and a zone controller 322. Zone coordinator 308 can be any of zone coordinators 206-210 or 218. Zone controller 322 can be any of zone controllers 224, 230, 232, 236, 248, or 250. Zone coordinator 308 can be connected with system manager via system bus 254. For example, system bus 254 is shown connecting a first system bus datalink 304 within system manager 202 with a second system bus datalink 310 within zone coordinator 308. Zone coordinator 308 can connected with zone controller 322 via a zone bus 318. For example, zone bus 318 is shown connecting a first zone bus datalink 314 within zone coordinator 308 with a second zone bus datalink 320 within zone controller 322. Zone bus 318 can be any of zone busses 256-260 or 264. Zone controller 322 is connected with networked sensors 238 and actuators 332 via a SA bus 266.

BMS 200 can automatically discover new equipment connected to any of system bus 254, zone bus 318, and SA bus 266. Advantageously, the equipment discovery can occur automatically (e.g., without user action) without requiring the equipment to be placed in discovery mode and without sending a discovery command to the equipment. In some embodiments, the automatic equipment discovery is based on active node tables for system bus 254, zone bus 318, and SA bus 266. Each active node table can provide status information for the devices communicating on a particular bus. For example, the active node table 306 for system bus 254 can indicate which MSTP devices are participating in the token ring used to exchange information via system bus 254. Active node table 306 can identify the devices communicating on system bus 254 by MAC address or other device identifier. Devices that do not participate in the token ring (e.g., MSTP slave devices) can be automatically discovered using a net sensor plug and play (described in greater detail below).

The active node table for each communications bus can be stored within one or more devices connected to the bus. For example, active node table 306 can be stored within system manager 202. In some embodiments, active node table 306 is part of a system bus datalink 304 (e.g., a MSTP datalink) used by system manager 202 to communicate via system bus 254. System manager 202 can subscribe to changes in value of active node table 306 and can receive a notification (e.g., from system bus datalink 304) when a change in active node table 306. In response to a notification that a change in active node table 306 has occurred, system manager 202 can read active node table 306 to detect and identify the devices connected to system bus 254.

In some embodiments, a device list generator 302 within system manager 202 generates a list of the devices connected to system bus 254 (i.e., a device list) based on active node table 306 and stores the device list within system manager 202. The device list generated by system manager 202 can include information about each device connected to system bus 254 (e.g., device type, device model, device ID, MAC address, device attributes, etc.). When a new device is detected on system bus 254, system manager 202 can automatically retrieve the equipment model from the device if the device stores its own equipment model. If the device does not store its own equipment model, system manager 202 can retrieve a list of point values provided by the device. System manager 202 can then use the equipment model and/or list of point values to present information about the connected system bus devices to a user.

The active node tables for each zone bus can be stored within the zone coordinator connected to the zone bus. For example, the active node table 316 for zone bus 318 can be stored within zone coordinator 308. In some embodiments, active node table 316 is part of a zone bus datalink 314 (e.g., a MSTP datalink) used by the zone coordinator 308 to communicate via zone bus 318. Zone coordinator 308 can subscribe to changes in value of active node table 316 and can receive a notification (e.g., from zone bus datalink 314) when a change in active node table 316 occurs. In response to a notification that a change to active node table 316 has occurred, zone coordinator 308 can read active node table 316 to identify the devices connected to zone bus 318.

In some embodiments, a detector object 312 of zone coordinator 308 generates a list of the devices communicating on zone bus 318 (i.e., a device list) based on active node table 316 and stores the device list within zone coordinator 308. Each zone coordinator in BMS 200 can generate a list of devices on the connected zone bus. The device list generated by each zone coordinator 308 can include information about each device connected to zone bus 318 (e.g., device type, device model, device ID, MAC address, device attributes, etc.). When a new device is detected on zone bus 318, the connected zone coordinator 308 can automatically retrieve the equipment model from the device if the device stores its own equipment model. If the device does not store its own equipment model, the connected zone coordinator 308 can retrieve a list of point values provided by the device.

Zone coordinator 308 can incorporate the new zone bus device into the zoning logic and can inform system manager 202 that a new zone bus device has been added. For example, zone coordinator 308 is shown providing a field device list to system manager 202. The field device list can include a list of devices connected to zone bus 318 and/or SA bus 266. System manager 202 can use the field device list and the list of system bus devices to generate a device tree including all of the devices in BMS 200. In some embodiments, zone coordinator 308 provides an equipment model for a connected zone bus device to system manager 202. System manager 202 can then use the equipment model and/or list of point values for the new zone bus device to present information about the new zone bus device to a user.

In some embodiments, the device list generated by each zone coordinator 308 indicates whether system manager 202 should communicate directly with the listed zone bus device (e.g., VAV RTU 222, VAV zone controller 224, etc.) or whether system manager 202 should communicate with the intermediate zone coordinator 308 on behalf of the zone bus device. In some embodiments, system manager 202 communicates directly with zone bus devices that provide their own equipment models, but communicates with the intermediate zone coordinator 308 for zone bus devices that do not provide their own equipment models. As discussed above, the equipment models for zone bus devices that do not provide their own equipment model can be generated by the connected zone coordinator 308 and stored within the zone coordinator 308. Accordingly, system manager 202 may communicate directly with the device that stores the equipment model for a connected zone bus device (i.e., the zone bus device itself or the connected zone coordinator 308).

The active node table 330 for SA bus 266 can be stored within zone controller 322. In some embodiments, active node table 330 is part of the SA bus datalink 328 (e.g., a MSTP datalink) used by zone controller 322 to communicate via SA bus 266. Zone controller 322 can subscribe to changes in value of the active node table 330 and can receive a notification (e.g., from SA bus datalink 328) when a change in active node table 330 occurs. In response to a notification that a change to active node table 330 has occurred, zone controller 322 can read active node table 330 to identify some or all of the devices connected to SA bus 266. In some embodiments, active node table 330 identifies only the SA bus devices participating in the token passing ring via SA bus 266 (e.g., MSTP master devices). Zone controller 322 can include an additional net sensor plug and play (NsPnP) 324 configured to detect SA bus devices that do not participate in the token passing ring (e.g., MSTP slave devices).

In some embodiments, NsPnP 324 is configured to actively search for devices connected to SA bus 266 (e.g., networked sensors 238, actuators 332, lighting controllers 334, etc.). For example, NsPnP 324 can send a "ping" to a preconfigured list of MSTP slave MAC addresses. For each SA bus device that is discovered (i.e. responds to the ping), NsPnP 324 can dynamically bring it online. NsPnP 324 can bring a device online by creating and storing an instance of a SA bus device object representing the discovered SA bus device. NsPnP 324 can automatically populate the SA bus device object with all child point objects needed to collect and store point data (e.g., sensor data) from the newly discovered SA bus device. In some embodiments, NsPnP 324 automatically maps the child point objects of the SA bus device object to attributes of the equipment model for zone controller 322. Accordingly, the data points provided by the SA bus devices can be exposed to zone coordinator 308 and other devices in BMS 200 as attributes of the equipment model for zone controller 322.

In some embodiments, a detector object 326 of zone controller 322 generates a list of the devices connected to SA bus 266 (i.e., a device list) based on active node table 330 and stores the device list within zone controller 322. NsPnP 324 can update the device list to include any SA bus devices discovered by NsPnP 324. The device list generated by zone controller 322 can include information about each device connected to SA bus 266 (e.g., device type, device model, device ID, MAC address, device attributes, etc.). When a new device is detected on SA bus 266, zone controller 322 can automatically retrieve the equipment model from the device if the device stores its own equipment model. If the device does not store its own equipment model, zone controller 322 can retrieve a list of point values provided by the device.

Zone controller 322 can incorporate the new SA bus device into the zone control logic and can inform zone coordinator 308 that a new SA bus device has been added. Zone coordinator 308 can then inform system manager 202 that a new SA bus device has been added. For example, zone controller 322 is shown providing a SA device list to zone coordinator 308. The SA device list can include a list of devices connected to SA bus 266. Zone coordinator 308 can use the SA device list and the detected zone bus devices to generate the field device list provided to system manager 202. In some embodiments, zone controller 322 provides an equipment model for a connected SA bus device to zone coordinator 308, which can be forwarded to system manager 202. System manager 202 can then use the equipment model and/or list of point values for the new SA bus device to present information about the new SA bus device to a user. In some embodiments, data points provided by the SA bus device are shown as attributes of the zone controller 322 to which the SA bus device is connected.

Additional features and advantages of BMS 200, system manager 202, zone coordinator 308, and zone controller 322 are described in detail in U.S. patent application Ser. No. 15/179,894 filed Jun. 10, 2016, the entire disclosure of which is incorporated by reference herein.

Network Routing System

Figure 4A:
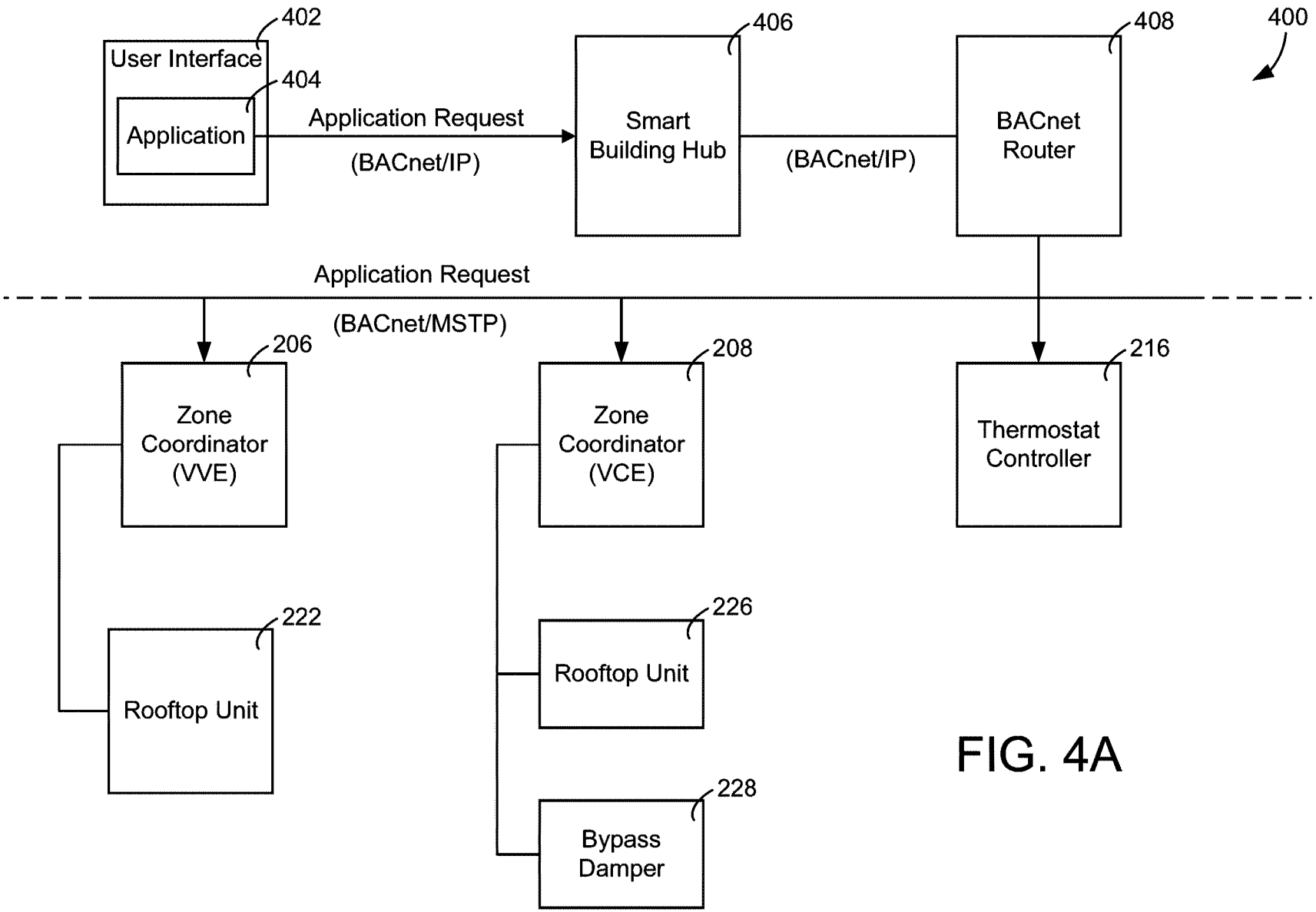
FIGS. 4A-C are block diagrams of a building network, which can be used to monitor and control the building and HVAC system of FIG. 1, according to some embodiments.
Figure 4B:
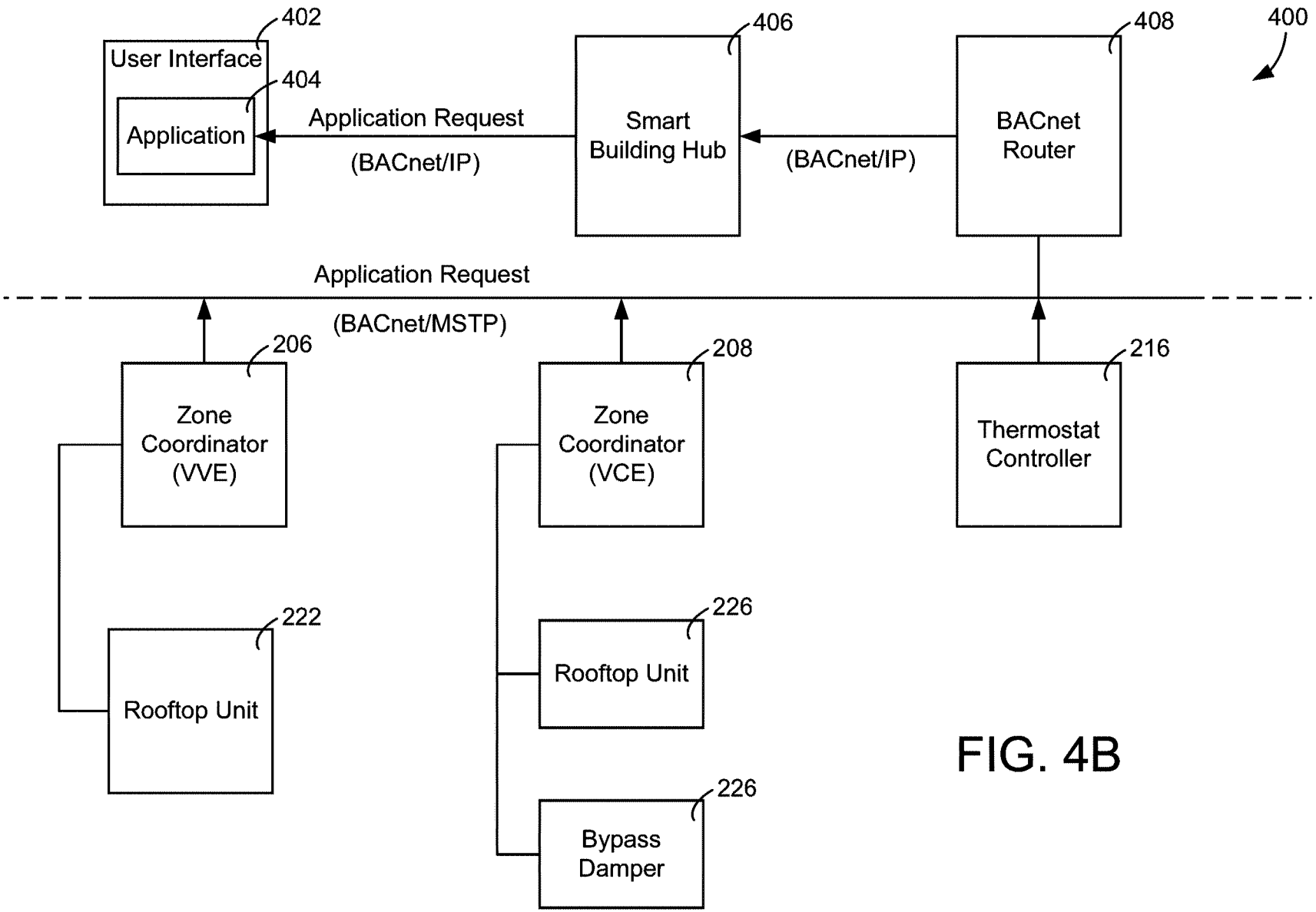

Referring to FIG. 4A, a system 400 for providing an application request to a routing device is shown, according to some embodiments. Referring to FIG. 4B, system 400 for responding to an application request is shown, according to some embodiments. FIG. 4B shows zone coordinator 206, zone coordinator 208, and thermostat controller 216 responding to an application request (e.g., the application request as shown in FIG. 4A) and providing device information to router 408 for routing to application 404. Referring now to FIGS. 4A-4B, a system 400 for providing and receiving application requests are shown, according to exemplary embodiments. System 400 may be incorporated partially or entirely into system 200 as shown in FIG. 2. In some embodiments, system 400 is a part of system 200. System 400 is shown to include user interface 402, smart building hub 406, and BACnet router 408.

User interface 402 may be any display capable of displaying information related to systems 200, 400, building 10, or any other system disclosed herein. User interface 402 may be provided on a laptop, smartphone, workstation, or other computing device. In some embodiments, HVAC client devices (e.g., devices for HVAC technicians within building 10) may display user interface 402. In some embodiments, user interface 402 may be configured to display the alarms, conditions, subsystems, and operational status of the BMS for building 10, such as Verasys as sold by Johnson Controls Inc. or Metasys as sold by Johnson Controls Inc. via application 404. In some embodiments, user interface 402 displays application 404 (e.g., phone application, phone app, etc.), which is provided as a software as a service (SaaS). For example, the processing and storage of application 404 for monitoring/controlling a building management system (e.g., Verasys) is performed at a data center located in a different area (e.g., different state, different country, etc.) than building 10. When a client device (e.g., a device hosting user interface 402) requests application 404, application 404 is provided to user interface 402 via a network (e.g., the Cloud, the Internet, etc.). In some embodiments, application 404 is any network software application that utilizes the Internet or other interconnected network infrastructure (e.g., the cloud, etc.) to perform various functionality (e.g., data transfer, etc.). Application 404 may include pure network applications and standalone network applications.

Smart building hub (SBH) 406 may be configured to act as a scalable control center for system 400 and/or system 200 that manages multiple building zones and building applications in real time. SBH 406 may incorporate some or all of the features of system manager 202 as shown in FIG. 2. In some embodiments, SBH 406 is a central controller configured to receive device information from zone coordinators (e.g., zone coordinator 206), controllers (e.g., thermostat controller 216), and various other devices on the network. SBH 406 may be connected via BACnet protocol under a master slave token passing (MS/TP) protocol such that SBH 406 acts as a "master" configured to request services from one or more slave devices. In other embodiments, SBH is connected to a different BACnet protocol, such as BACnet/IP or BACnet/Ethernet.

BACnet router 408 (i.e., "router 408") may be configured to receive and forward data packets along a network. In some embodiments, router 408 routes data from a first network to a second network. As shown in FIG. 4A, router 408 is connected to a BACnet/IP network (via SBH 406) and is connected to a BACnet/MSTP network (via zone coordinators 206, 208 and thermostat controller 216). Router 408 may be configured to route data between various networks that operate under the Building Automation and Control networks (BACnet) protocol. In other embodiments, router 408 routes data between networks that operate under other building protocols, such as Modbus or LonWorks. Router 408 may be configured to optimize routing capabilities within system 400 that allow application requests to be completed using efficient methods (e.g., converting multiple application responses into a single response for application 404). Further detail relating to router 408 and improved routing capabilities are discussed in greater detail below with reference to FIG. 6.

In some embodiments, SBH 406 and router 408 are not separate devices, and SBH 406 performs all of the routing functionality of router 408. In other embodiments, SBH 406 is not included in system 400, and router 408 receives application requests from application 404 and device information from controllers. In such an embodiment, device information from data objects stored on system controllers (e.g., zone coordinator 206, etc.) are provided to router 408, for forwarding to user interface 402.

Still referring to FIG. 4A, SBH 406 is configured to receive application requests from an application (e.g., application 404) on user interface 402 and request services from lower-level controllers (i.e., controllers that a below SBH 406 on the network), such as zone coordinator 206. For example, a user interacts with application 404 and clicks on a widget titled, "Power Consumption of Rooftop Units in the Building." Application 404 sends this application request to SBH 406 and SBH 406 receives the application request and requests zone coordinator 206 to provide the power consumption for rooftop unit 222 and requests zone coordinator 208 to provide the power consumption for rooftop unit 226. Once received, SBH 406 may collect the multiple responses received and provide a single response to application 404.

This process for collecting the multiple responses received and providing a single response to application is discussed in greater detail below with reference to FIG. 6.

In another example, a user interacts with application 404 and clicks on a widget titled, "Temperature of HVAC Equipment." Application 404 sends this application request to SBH 406. SBH 406 receives the application request and requests the temperature information for various HVAC equipment (e.g., boilers, chillers, rooftop units, etc.). This may include receiving information from HVAC equipment not shown in FIG. 4A. In some embodiments, the data (e.g., temperature data in the above example) may be stored in zone coordinator 206 as part of a data object (e.g., data models, etc.). In such an embodiment, most or all information relating to rooftop unit 222 (e.g., the seasonal energy efficiency ratio (SEER) rating, sound level (dB), operation temperature, power consumption, current draw, etc.) is received and stored within zone coordinator 206. In other embodiments, the data or data models are provided to SBH 406.

Figure 4C:
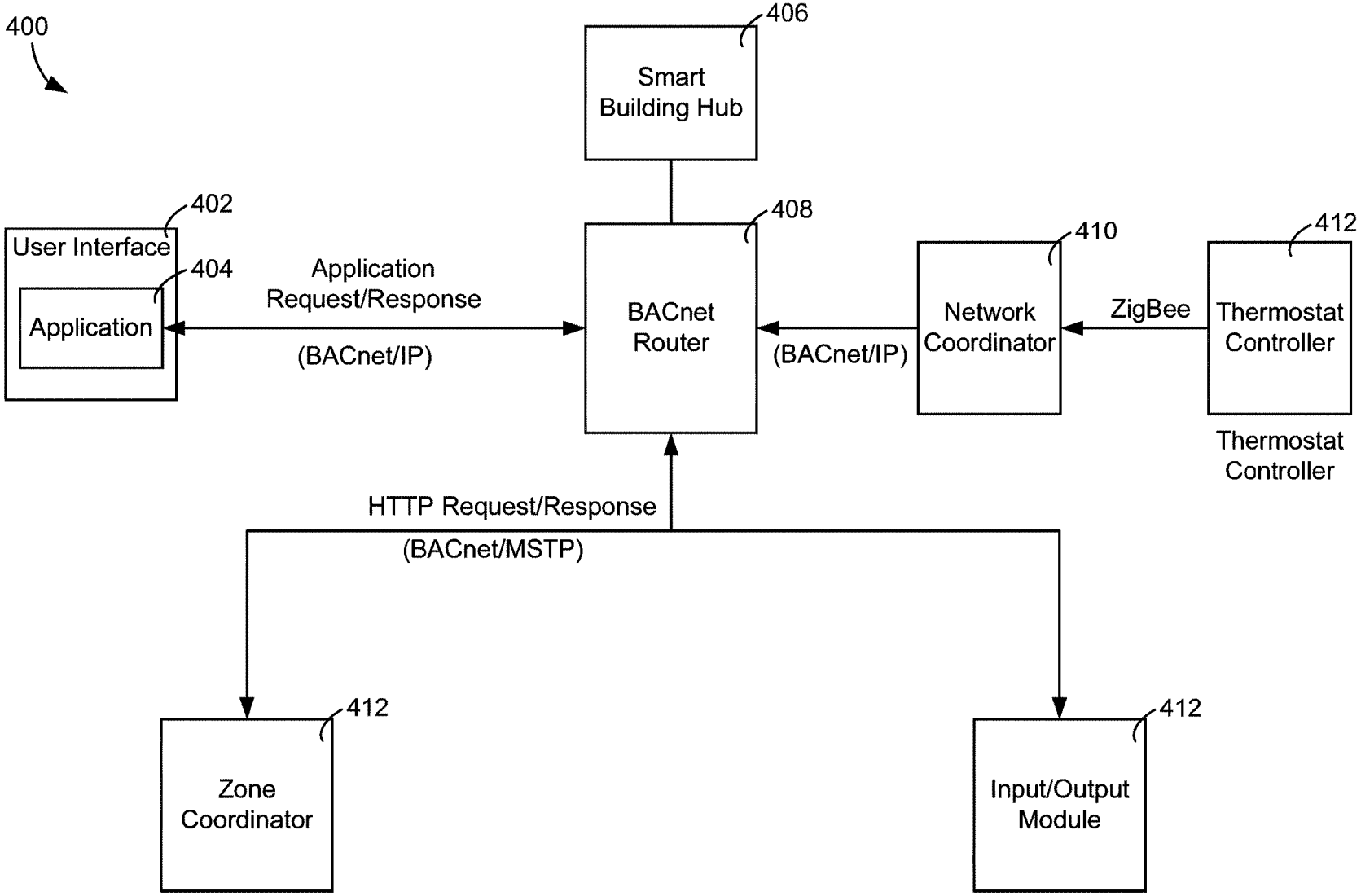

Referring now to FIG. 4C, another method of providing responses to application requests within system 400 is shown, according to an exemplary embodiment. System 400 is shown to have router 408 routing the data between networks (e.g., BACnet/IP and BACnet/MSTP) without the data passing through SBH 0406. FIG. 4C shows various networks providing data to BACnet router 408, including BACnet/MSTP and ZigBee (i.e., IEEE 802.15.4) wireless communication. System 400 is shown to include network coordinator 410 and thermostat 412.

Network coordinator 410 may be configured to provide a network connection between two networks, wherein one network operates under one communications protocol and the other operates under a different communications protocol. For example, network coordinator 410, as shown in FIG. 4C, connects thermostat controller 412 (which communicates under Zigbee communications protocols) with BACnet/IP to router 408. Accordingly, system 400 is capable of networking data under the BACnet communications protocol, which includes data from a separate, non BACnet compatible network (e.g., Zigbee).

In a general embodiment, system 400 operates under a building automation protocol such as BACnet. To communicate between devices within a BAS under BACnet, devices may provide services to other devices. As disclosed herein, a service may be a means or interface between two devices to access and process information, request to perform an action, or inform the devices that some event has taken place. In some embodiments, some services that may be implemented in system 500 include who-is, I-am, who-has, I-have, read-property, and write-property. Additionally, the services may be based, at least in part, on objects. Various advanced services may be implemented in system 500 including ready property multiple, write property multiple, and subscribe COV property.

In some embodiments, a read property multiple is a single request to read multiple properties from a BACnet object instead of having to send multiple read property requests. For example, application 404 provides a request to router 408 that includes reading multiple properties (e.g., name, device type, power consumption, operating temperature) from a BACnet object (e.g., boiler, chiller, etc.). Router 408 receives the multiple properties from the BACnet object and provides a single response to application 404. In some embodiments, read property multiple includes reading multiple properties from multiple different BACnet objects (e.g., multiple boilers, chillers, RTU's, controllers, etc.).

In some embodiments, write property multiple is a single request to write multiple properties of a BACnet object instead of having to send multiple write property requests. For example, application 404 provides a request to router 408 that includes writing multiple properties of a BACnet object (e.g., operating thresholds, maximum current draw, device name, etc.). Write properly multiple may allow application 404 to provide a single write request for several properties of one or more BACnet objects. In some embodiments, write property multiple includes writing multiple properties from multiple different BACnet objects (e.g., multiple boilers, chillers, RTU's, controllers, etc.).

In some embodiments, subscribe COV property is an ability to sign up for notifications of changes of vale (COVs) of a property of a BACnet object instead of having to poll the value. For example, application 404 may provide a request to sign up for notifications of COV's of temperature values for thermostat controller 412. When the temperature changes over a predetermined threshold, router 408 may pull the temperature from the data object of thermostat controller 412 and provide the data to application 404 automatically.

Figure 5:
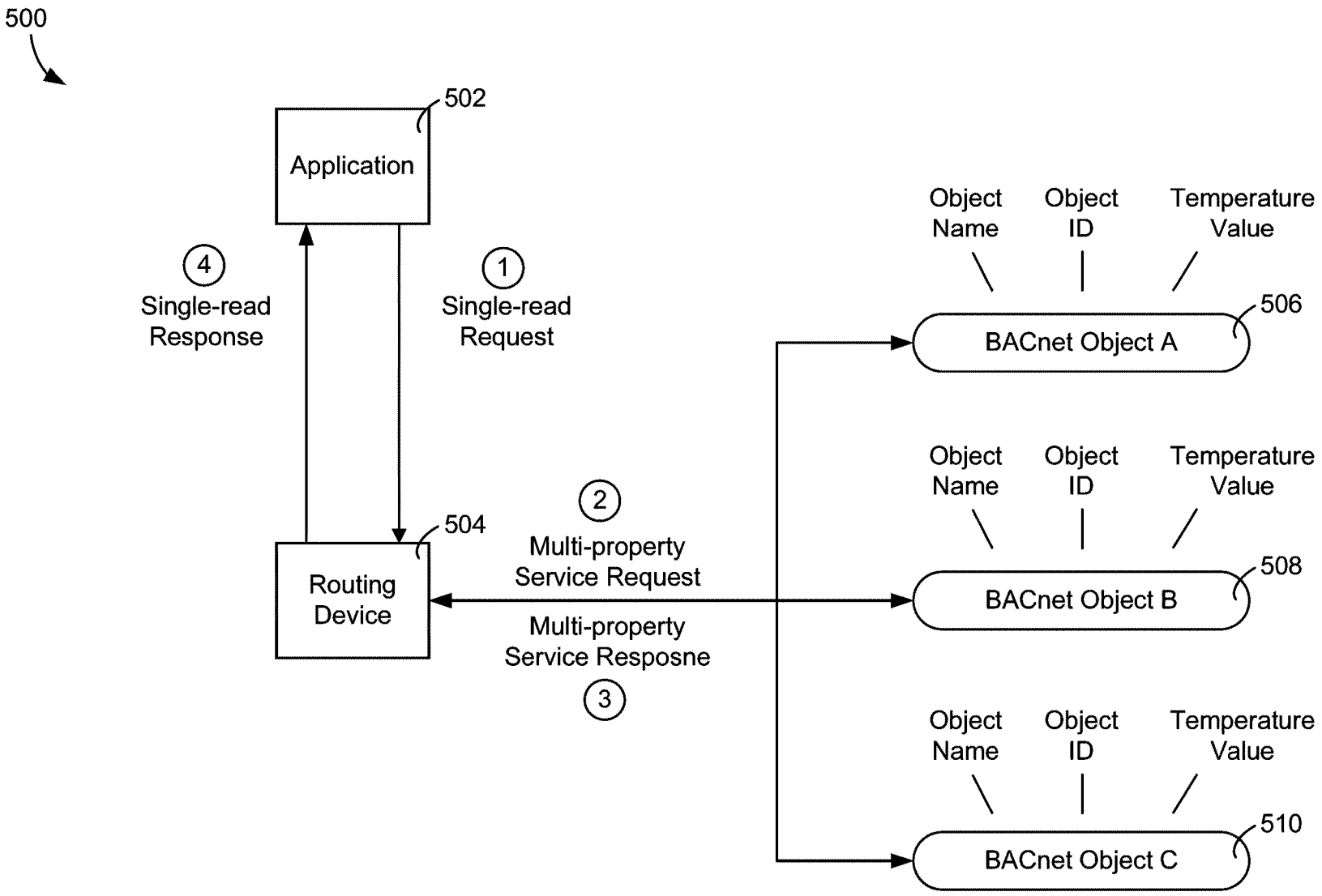
FIG. 5 is a block diagram of a system for representing data objects in a building network, which can be used in the networks for FIGS. 4A-C, according to some embodiments.

Referring now to FIG. 5, a system 500 (e.g., a high level system 500) for engaging in services of a BAS network is shown, according to an exemplary embodiment. System 500 is shown to include application 502, routing device 504, and BACnet objects 506-510. System 500 may be an abstract (e.g., high-level) embodiment that shows how various requests from application 502 may be received by routing device 504 and responded to, based on information from BACnet objects 506-510. In some embodiments, system 500 outlines a read property multiple request, as described above.

BACnet objects 506-510 may be configured to be representations (e.g., virtual) of devices, parameters, points, or instances within system 200, 400, 500, or any combination thereof. In some embodiments, devices, inputs (e.g., analog input), and outputs (e.g. binary output) may be modeled as objects in a BACnet network. For example, BACnet object 506 includes a set of properties (e.g., operating temperature, power consumption, etc.) of a HVAC device (e.g., RTU, etc.) and the current status of the device. BACnet object 506 may be provided to other devices in the network. In some embodiments, BACnet objects 506-510 may include the following: binary input, binary output, binary value, analog input, analog output, analog value, averaging, LifeSafety Zone, LifeSafety Point, multi-state input, multi-state output, multi-state value, loop, calendar, notification class, command, file, program, schedule, trend log, group, event enrollment, device, or any combination thereof, and are not limited to device objects.

System 500 is shown to include application 502 providing a single read request to routing device 504 (Operation 1). Application 502 and routing device 504 may be substantially similar or identical to application 404 and router 408, respectively. In some embodiments, the single read request includes application 502 providing a request to view operational parameters of BACnet Object 506. BACnet object 506 may be an object of an RTU (e.g., device object).

System 500 is shown to include routing device 504 receiving the single read request and requesting properties from BACnet objects 506-510 that will satisfy the single read request (Operation 2) and BACnet objects 506-510 providing the properties to routing device 504 (Operation 3). Routing device 504 may be the "master" device in a BACnet/MSTP network and request properties from BACnet objects 506-510 that will satisfy the single read request.

System 500 is shown to further include application 502 receiving a single read response from routing device 504 (Operation 4). Application 502, even though it requested several properties of a BACnet object to be read, receives a single response automatically. Routing device 504 converted the multi-property responses into a single read response for application 502, rather than providing several read responses (e.g., one for each property of the data objects). Advantageously, this can simplify application 502 by automatically providing advanced BACnet services to application 502. This simplifies post-processing of the data, as application 502 knows it received all of the data requested in the single read request, as opposed to tracking all of the asynchronous requests and responses, caching the received responses with portions of the data, and processing the data once application 502 has received all of the responses. The functionality of optimizing network routing within a BACnet router is described in greater detail below with reference to FIG. 6.

Figure 6:
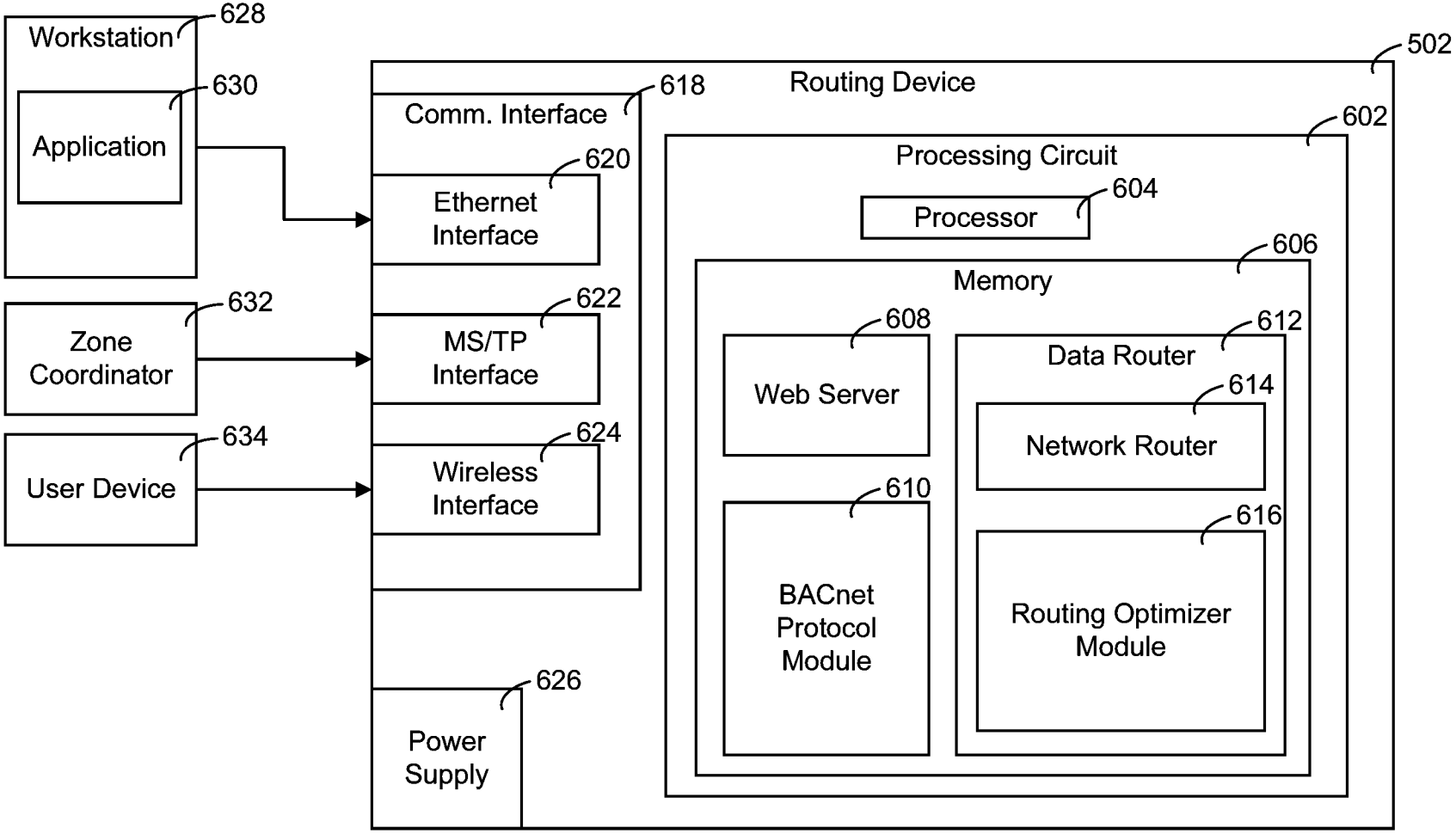
FIG. 6 is a block diagram of a routing device, which can be used in the system of FIG. 5, according to some embodiments.

Referring now to FIG. 6, a block diagram of routing device 504 is shown, according to an exemplary embodiment. Routing device 504 may include some or all of the functionality of various routers described herein, including BACnet router 408. Routing device 504 is shown to include processing circuit 602, communications interface 618, and power supply 626.

Communications interface 618 can facilitate communications between routing device 504 and various devices within building 10, such as workstation 628, zone coordinator 632, and user device 634. Interface 618 can be or include wired or wireless communications interfaces (e.g., jacks, antennas, transmitters, receivers, transceivers, wire terminals, etc.) for conducting data communications within systems 400, 500, or 600 or other external systems or devices. In various embodiments, communications via interfaces 618 can be direct (e.g., local wired or wireless communications) or via a communications network (e.g., a WAN, the Internet, a cellular network, etc.). For example, interfaces 618 can include an Ethernet card and port for sending and receiving data via an Ethernet-based communications link or network (e.g., Ethernet interface 620). In another example, interface 618 can include a Wi-Fi transceiver for communicating via a wireless communications network (e.g., wireless interface 624). In another example, interface 618 can include an MS/TP port for communicating via Master Slave Token Passing protocol, which may or may not be under BACnet (e.g., MS/TP interface 622).

Power supply 626 may be configured to provide a constant power to routing device 504. Power supply 626 may be a constant DC voltage supplied (e.g., 10 VDC). In other embodiments, power supply 626 is an AC supply (e.g., 120 VAC at 60 Hz). Processing circuit 602 is shown to include processor 604 and memory 606.

Processing circuit 602 can be communicably connected to communications interface 618 such that processing circuit 602 and the various components thereof can send and receive data via communications interface 618. Processor 604 can be implemented as a general purpose processor, an application specific integrated circuit (ASIC), one or more field programmable gate arrays (FPGAs), a group of processing components, or other suitable electronic processing components.

Memory 606 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 606 can be or include volatile memory or non-volatile memory. Memory 606 can include database components, object code components, script components, or any other type of information structure for supporting the various activities and information structures described in the present application. According to an example embodiment, memory 606 is communicably connected to processor 604 via processing circuit 602 and includes computer code for executing (e.g., by processing circuit 602 and/or processor 604) one or more processes described herein. Memory 606 is shown to include web server 608, BACnet protocol module 610, and network router 614.

Web server 608 may be configured to allow for commissioning (e.g., updating) and troubleshooting using a standard web browser. In some embodiments, routing device 504 can be accessed over the internet to adjust various routing parameters. For example, user device 634 may connected to wireless interface 624 via a web browser to update a routing table of routing device 504. The routing table may include information about the network topology of the surrounding BACnet network (e.g., systems 200, 400, 500, any combination thereof, etc.).

BACnet protocol module 610 may include the necessary and usable functionality to implement routing device 504 to operate under BACnet protocol. For example, BACnet/MSTP protocol typically uses EIA-485 (RS-485) wiring as the physical layer (e.g., Layer 1 of the Open Systems Interconnection (OSI) model). As such, BACnet protocol module 610 may allow routing device 504 to receive data over that and other physical layers (e.g., Ethernet). BACnet protocol module 610 may also provide information on the maximum number of devices capable of being connected to routing device 504.

Data router 612 is configured to route received data packets to routing device 504 to another network within the BACnet system. Data router 612 is shown to include network router 614 and routing optimizer module 616. Network router 614 may act as the standard networking processes usable for receiving and forwarding data packets and/or datagrams. In some embodiments, network router 614 handles the networking layer (i.e., Layer 3 of the OSI model). Network router 614 and data router 612 may be configured to act as a single module.

Routing optimizer module 616 is configured to optimize the network trafficking within system 200, 400, and/or 500. In some embodiments, routing optimizer module 616 is configured to receive multiple properties from BACnet objects (e.g., BACnet objects 506-510) and convert the number of property responses to the number of responses requested by application 502. Various other processes and functionality that may be performed by routing optimizer module 616 are discussed in greater detail below with reference to FIGS. 7-9.

Network Routing Processes

Figure 7:
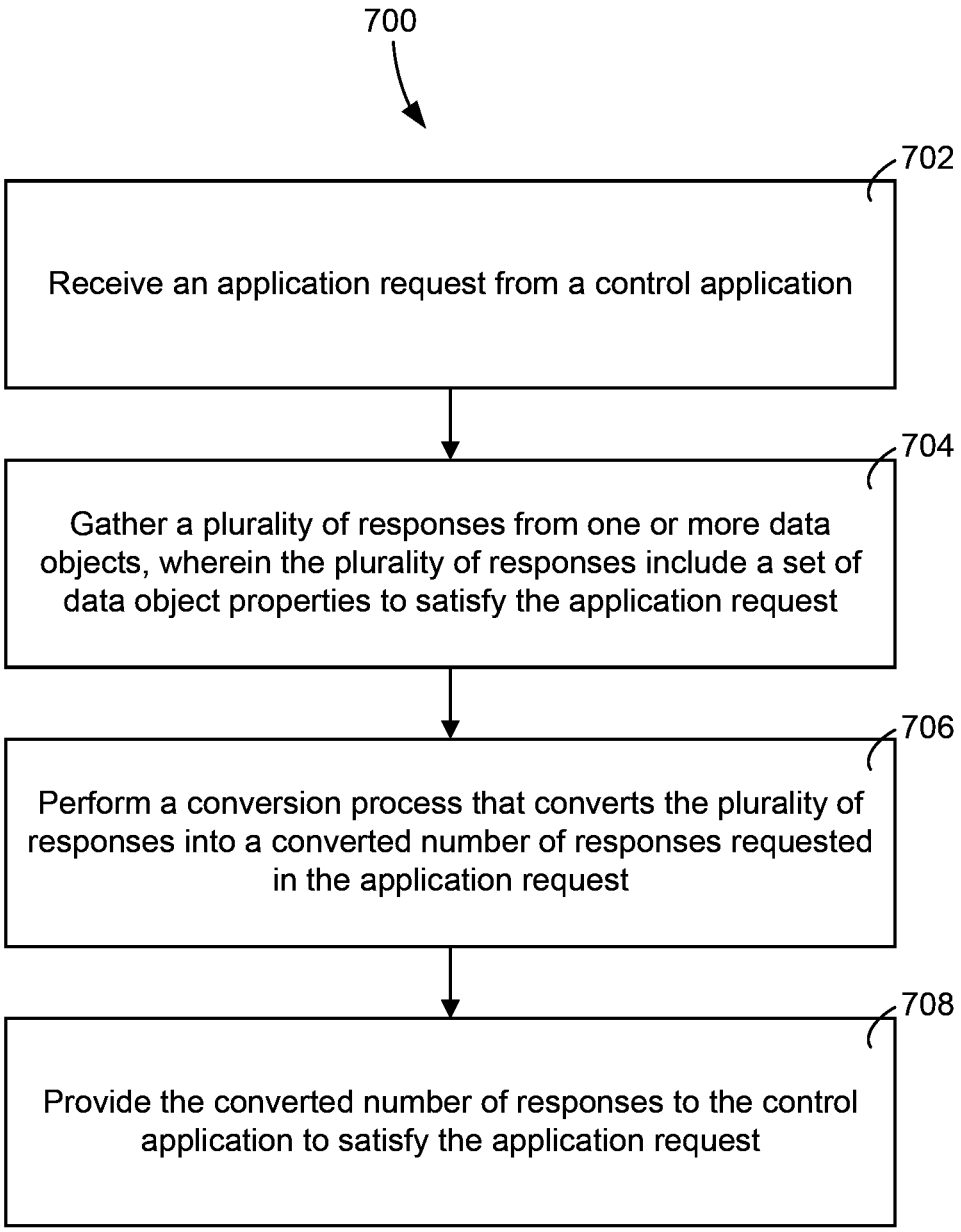
FIGS. 7-9 are flow diagrams of processes for optimizing network traffic in a network, which can be performed by the routing device in FIG. 6, according to some embodiments.

Referring now to FIG. 7, a process 700 for handling (e.g., optimizing) network traffic in a BMS is shown, according to an exemplary embodiment. Process 700 may be performed by routing optimizer module 616 in routing device 504, by any other routing device described herein, including BACnet router 408, or by any communication device involved in or cooperating to communicate network traffic. Process 700 is shown to include receiving an application request from a control application (operation 702). In some embodiments, application 404 provides an advanced service request, such as read property multiple, write property multiple, or subscribe COV property, as described with reference to FIG. 4C above. In some embodiments, application 404 sends an application request to routing device 504. Operation 702 is described in greater detail below with reference to FIG. 8.

Process 700 is shown to include gathering a plurality of responses from one or more data objects, wherein the plurality of responses includes a set of data object properties to satisfy the application request (operation 704). In some embodiments, routing device 504 gathers properties of data objects (e.g., BACnet objects 506-510) as shown in FIG. 5. The data objects may be located on the device of which the data object is generated. For example, thermostat controller 412 may store the device object for thermostat controller 412. When routing device 504 requests the properties of the device object for thermostat controller 412, thermostat controller 412 may provide the properties from the device object. In other embodiments, the objects (e.g., device objects, input objects, etc.) are stored on supervisory devices, such as zone coordinator 206 as shown in FIG. 2. Supervisory devices (e.g., zone coordinator 206, system manager 202, etc.) may store device objects of the respective supervisory devices, device objects of lower-level controllers (e.g., VAV zone controller 224, etc.) or a combination of both.

Process 700 is shown to include performing a conversion process that converts the plurality of responses into a converted number of responses requested in the application request (operation 706) and providing the converted number of responses to the control application to satisfy the application request (operation 708). Operations 706-708 may be performed by routing optimizer module 616, as shown in FIG. 6. In some embodiments, routing optimizer module 616 receives several (e.g., 5, 10, 50, etc.) responses after requesting properties from BACnet objects 506-510. Routing optimizer module 616 will convert the number of requests received from the BACnet objects 506-510 to the number of requests requested by application 502. For example, if application 502 requests a single read request to read 5 properties of BACnet object 508, routing optimizer module 616 will receive 5 responses from BACnet object 508. Routing optimizer module 616 will then convert the 5 responses to a single read response and provide the single read response to application 502.

In another example, application 502 provides a single request to write 3 properties to BACnet object 510—Object name, Object ID, and Temperature Value. Routing device 504 receives the single request from application 502 and converts the single request into 3 write requests for BACnet object 510 and provides the requests to BACnet object 510. In some embodiments, routing device 504 will provide a notification update (e.g., success update) after the request has been responded to. Operation 706 is discussed in greater detail below with reference to FIG. 9.

Figure 8:
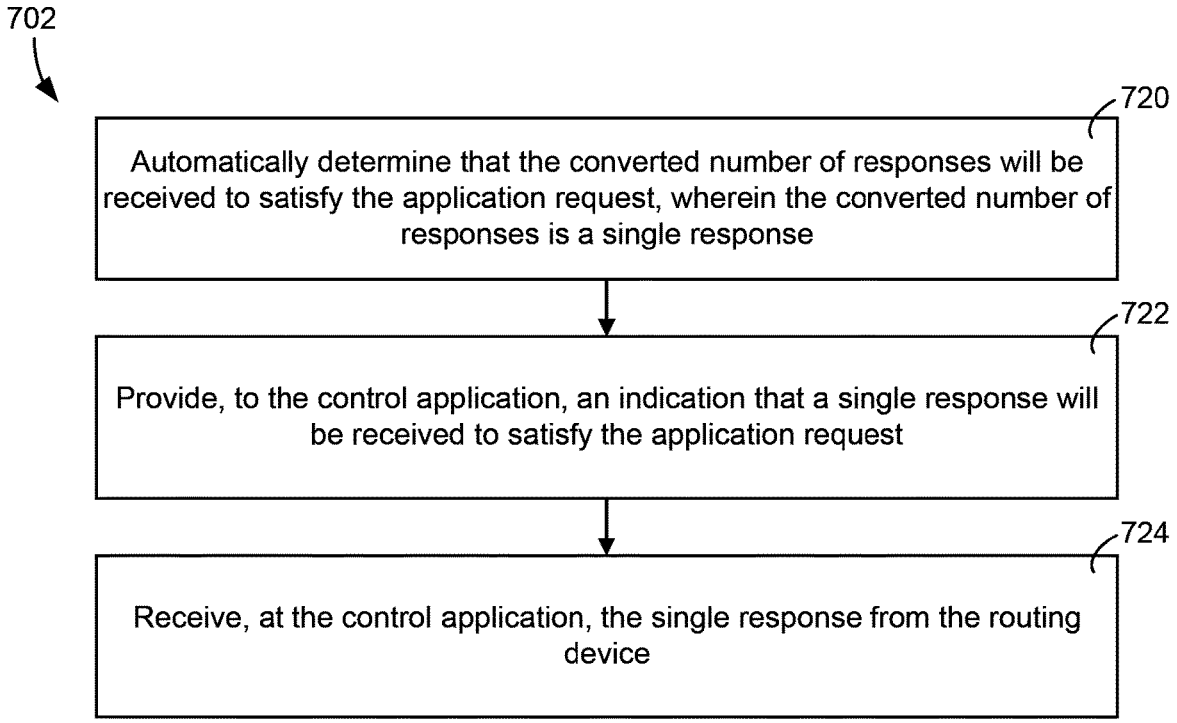

Referring now to FIG. 8, sub-steps of step 702 are shown, according to an exemplary embodiment. Operation 702 is shown to include automatically determining that the converted number of responses will be received to satisfy the application request, wherein the converted number of responses is a single response (operation 720). In a general embodiment, networking traffic can be optimized as application 404 does not need to post-process multiple responses, as it has already been converted into a single response. Operation 720 shows application 404 requesting a single request to routing device 504.

Operation 702 is shown to include providing, to the control application, an indication that a single response will be received to satisfy the application request (operation 722). In some embodiments, routing device 504 provides the process of automatically optimizing the routing within the system. For example, a setting may be turned on that allows routing device 504 to convert the number of responses received from BACnet objects 506-510 to the number of responses requested by application 404. Routing device 504 may then provide this information to application 502.

Operation 702 is shown to include receiving, at the control application, the single response from the routing device (operation 724). The single response may be received at application 502, as application 502 expected. As application 502 expected a single response, application 502 does not need to cache the responses and wait until all responses have arrived from routing device 504 before processing. Instead, the data does not need to be post-processed as it is already a single response.

Figure 9:
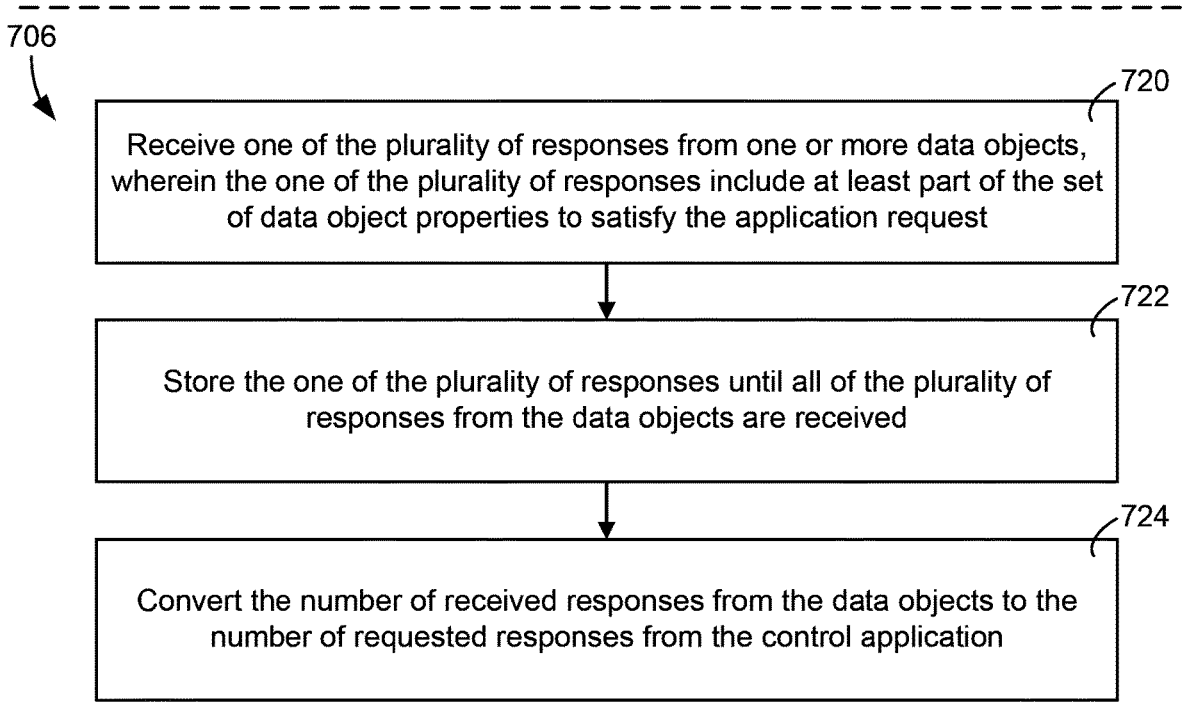

Referring now to FIG. 9, sub-steps of operation 706 are shown, according to an exemplary embodiment. Operation 706 is shown to include receiving one of the plurality of responses from one or more data objects, wherein the one of the plurality of responses include at least part of the set of data object properties to satisfy the application request (operation 720). This operation may be similar to operation 3 as shown in FIG. 5. Routing device 504 may receive properties from BACnet data objects 506-510.

Operation 706 is shown to include storing the one of the plurality of responses until all of the plurality of responses from the data objects are received (operation 722). In some embodiments, the responses received from BACnet objects 506-510 do not arrive at routing device 504 at the same time. In such an embodiment, routing device 504 may store one or more of the received responses in memory 606, until all responses are received.

Operation 706 is shown to include converting the number of received responses from the data objects to the number of requested responses from the control application (operation 724). In the above example, once all of the responses are received, routing device 504 may then convert the number of responses received from BACnet objects 506-510 to the number of responses requested by application 404 and provide the converted number of response to application 404.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method operations may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A building management system (BMS) for providing network traffic, the system comprising:

a device providing a control application for the BMS; and a zone controller comprising a processing circuit configured to:

receive a request from the control application;

manage network traffic in responding to the request by:

gathering, at the zone controller, a plurality of responses from one or more data objects, wherein the plurality of responses include a set of data object properties to satisfy the request;

performing, at the zone controller, a conversion process that converts the plurality of responses into a converted number of responses requested in the request in response to a number of the plurality of responses, wherein the converted number of responses comprises the set of data object properties; and providing, to the control application via the network traffic, the converted number of responses to the control application to satisfy the request such that the control application receives the converted number of responses without requiring the control application to receive the plurality of responses from the one or more data objects.

2. The system of claim 1, wherein:

the system further comprises one or more additional controllers configured to store the one or more data objects; and the zone controller and one or more devices are configured to communicate via building automation control networks (BACnet) protocols, the BACnet protocols including BACnet/Ethernet, BACnet/IP, and BACnet/MSTP.

3. The system of claim 1, wherein gathering the plurality of responses from the one or more data objects comprises:

instructing a controller in the BMS to provide one or more of the data objects stored thereon; and receiving at least one of an object name, object ID, or operational parameter of the data object, wherein the data object is a device object.

4. The system of claim 1, wherein:

the request is a read property multiple request to read the set of data object properties in a single response;

gathering, at the zone controller, the plurality of responses from the one or more data objects comprises asynchronously receiving the plurality of responses from the one or more data objects; and the conversion process comprises aggregating the plurality of responses received asynchronously into the single response to be provided to the control application.

5. The system of claim 1, wherein the request comprises:

a write property multiple request to write the set of data object properties in a single write request; or a subscribe COV property request to notify the control application when the set of data object properties changes substantially.

6. The system of claim 1, wherein, responsive to receiving the request from the control application, the zone controller is configured to:

automatically determine, based on the request, the converted number of responses to be provided to satisfy the request;

providing, to the control application, an indication that the converted number of responses will be received by the control application to satisfy the request.

7. The system of claim 1, wherein performing the conversion process that converts the plurality of responses into the converted number responses comprises:

receiving one of the plurality of responses from the one or more data objects prior to receiving another of the plurality of responses, wherein the one of the plurality of responses include at least part of the set of data object properties to satisfy the request;

storing the one of the plurality of responses until all of the plurality of responses from the data objects are received; and converting the number of responses from the data objects to the converted number of responses to be provided to the control application such that the control application receives the converted number of responses without requiring the control application to asynchronously receive the plurality of responses from the one or more data objects.

8. A method of providing network traffic in a building heating, ventilation, or air conditioning (HVAC) system, the method comprising:

receiving, at a network device and via a network, a request from a control application for a first number of responses relating to the HVAC system;

gathering, at the network device and responsive to the request, a second number of responses obtained from a plurality of objects of the HVAC system;

performing, at the network device, a conversion process that converts the second number of responses into the first number of responses requested in the request; and providing the network traffic by providing the first number of responses to the control application to satisfy the request.

9. The method of claim 8, wherein receiving the request from the control application comprises:

receiving at least one of a read property multiple request, write property multiple request, or subscribe COV property request from a building automation control networks (BACnet) protocol; and wherein the BACnet protocol is at least one of a BACnet over Ethernet (BACnet/Ethernet), BACnet over industrial protocol (BACnet/IP), or BACnet over master slave token passing (BACnet/MSTP).

10. The method of claim 8, wherein:

the plurality of objects comprise one or more data objects stored on one or more controllers; and the control application, the network device, and the one or more controllers are configured to communicate via building automation control networks (BACnet) protocols, the BACnet protocols including BACnet/Ethernet, BACnet/IP, and BACnet/MSTP.

11. The method of claim 8, wherein gathering a plurality of responses comprises:

instructing a controller in the BMS to provide one or more of the objects stored thereon; and receiving at least one of an object name, object ID, or operational parameter of the object, wherein the object is a device data object.

12. The method of claim 8, wherein receiving the request comprises receiving a read property multiple request requesting a set of data object properties in a single response.

13. The method of claim 8, wherein receiving the request comprises receiving a write property multiple request configured to write a set of data object properties in a single write request.

14. The method of claim 8, comprising:

automatically determining that the first number of responses will be received to satisfy the request, wherein the first number of responses is one response;

providing, from the network device to the control application, an indication that the one response will be received to satisfy the request; and receiving, at the control application, the one response.

15. The method of claim 8, wherein performing the conversion process comprises:

asynchronously receiving the second number of responses at the network device until all of the second number of responses from the objects are received; and combining the second number of responses into the first number of the responses requested by the control application to be provided together to the control application.

16. A zone network device for routing network traffic in a building management system (BMS), the zone network device comprising:

a communications interface configured to communicate with a device providing a control application for the BMS; and a processing circuit configured to:

receive a request from the control application;

coordinate network traffic for one or more data objects providing data object properties responsive to the request by:

gathering, at the zone network device, a plurality of responses from the one or more data objects, wherein the plurality of responses include a set of data object properties to satisfy the request;

performing, at the zone network device, a conversion process that converts the plurality of responses into a converted number of responses requested in the request, in response to a number of the plurality of responses gathered, wherein the converted number of responses comprises the set of data object properties; and providing, from the zone network device, the converted number of responses to the control application to satisfy the request via the network traffic.

17. The zone network device of claim 16, wherein:

the system further comprises one or more controllers configured to store the one or more data objects; and the zone network device and the one or more controllers are configured to communicate via building automation control networks (BACnet) protocols, the BACnet protocols including BACnet/Ethernet, BACnet/IP, and BACnet/MSTP.

18. The zone network device of claim 16, wherein gathering a plurality of responses from the one or more data objects includes:

instructing a controller in the BMS to provide one or more of the data objects stored thereon; and receiving at least one of an object name, object ID, or operational parameter of the data object, wherein the data object is a device object.

19. The zone network device of claim 16, wherein the request comprises a read property multiple request to read the set of data object properties in a single response.

20. The zone network device of claim 16, wherein the request comprises:

a write property multiple request to write the set of data object properties in a single write request; or a subscribe COV property request to notify the control application when the set of data object properties changes substantially.

* * * * *